US010920573B1

(12) United States Patent
Adkins

(10) Patent No.: US 10,920,573 B1
(45) Date of Patent: Feb. 16, 2021

(54) LOCKING LID FOR DOWNHOLE TOOLS

(71) Applicant: Hunting Energy Services, LLC, Houston, TX (US)

(72) Inventor: Gregory Lynn Adkins, Lafayette, LA (US)

(73) Assignee: Hunting Energy Services, LLC, Houston, TX (US)

( * ) Notice: Subject to any disclaimer, the term of this patent is extended or adjusted under 35 U.S.C. 154(b) by 0 days.

(21) Appl. No.: 16/657,452

(22) Filed: Oct. 18, 2019

(51) Int. Cl.
*E21B 47/01* (2012.01)
*E21B 7/04* (2006.01)

(52) U.S. Cl.
CPC ..... *E21B 47/01* (2013.01); *E21B 7/046* (2013.01)

(58) Field of Classification Search
CPC ..... E21B 47/01; E21B 7/046
USPC ..... 175/45
See application file for complete search history.

(56) References Cited

U.S. PATENT DOCUMENTS 5,934,391 A 8/1999 Cox
6,148,935 A * 11/2000 Wentworth ..... E21B 17/046 175/398
2002/0053471 A1* 5/2002 Blair ..... E21B 47/017 175/107
2012/0118640 A1* 5/2012 Runquist ..... E21B 7/064 175/57
2014/0265320 A1* 9/2014 Pollack ..... E21B 17/042 285/334

* cited by examiner

*Primary Examiner* — Taras P Bemko
(74) *Attorney, Agent, or Firm* — Whitaker Chalk Swindle & Schwartz PLLC; Charles Gunter

(57) ABSTRACT

A sonde housing for horizontal directional drilling includes a cylindrical housing body with walls defining a longitudinal cavity. A lid is provided for covering the cavity in the housing body. A series of tabs on the lid longitudinal side surfaces are engaged in mating grooves provided in the housing body to secure the lid on the housing body. A further independent locking member also engages the lid and housing body.

12 Claims, 7 Drawing Sheets

LOCKING LID FOR DOWNHOLE TOOLS

BACKGROUND OF THE INVENTION

1. Field of the Invention

The present invention relates generally to earth drilling operations and, in particular, to an improved hold-down system for a cover or lid which forms a part of a sonde housing used for horizontal directional drilling operations.

2. Description of the Prior Art

The conventional directional drilling apparatus (horizontal directional drilling or HDD apparatus) generally includes a series of drill rods joined end to end by threaded connections or joint couplings to form a drill string. The drill string is typically pushed or pulled though the earth by means of a hydraulic cylinder or gear rack mounted on the HDD machine. A drill bit or head is attached to the end of the drill string with a coupling and will typically include a fluid nozzle for delivering a drilling fluid to assist in the boring operation. In other applications, tools such as reamers, impact machines, pipe bursters, and the like are attached to the end of a drill string with a threaded connection or coupling.

Directional drilling systems of this type also incorporate what is referred to in the industry as a "sonde." The sonde transmits electromagnetic signals which are used for tracking the bit and thus the borehole, e.g., indicating such factors as the pitch (from horizontal), the clock (roll about a horizontal axis clockwise or counterclockwise from a reference of say 12 o'clock), and the depth of the sonde. The sonde thus enables a person sweeping the corridor with a receiver or detector to locate the horizontal or lateral position of the sonde in the specified corridor.

In the discussion which follows, the terms "sonde" and "monitoring/tracking device" will thus be taken to mean any device known in the trenchless boring industry as a surveying device for the monitoring and tracking of a bore hole. The term "boring device" will generally be taken to refer to the drilling apparatus, such as an HDD machine, or to any other device known in the art, to drill or lengthen the bore hole. The terms "entrenching device" and "mud motor" may be used to refer to portions of the drilling apparatus which are used to rotate a boring device, without turning the drill pipe/drill string, by some type of drilling rig to continue a hole or bore. The terms "cover" and "lid" are used interchangeably in the discussion which follows to describe the part of the sonde housing used to close off the body cavity and cavity opening.

Directional drilling systems of the type referred to above are sometimes referred to as "trenchless drilling," systems and are commonly used, e.g., to install utilities around immovable objects, such as roadways, rivers and/or lakes, etc. They may often be seen being used to tunnel under sidewalks and city streets to install such things as fiber optic cables, or other electrical utility lines.

The boring machine used in conventional horizontal boring techniques is thus commonly used to push and/or rotate a drill string, the drill string carrying a directable drill bit to achieve an underground path or direction through which a conduit or utility device can be installed. The sonde follows the drill bit as it is directed around, over or under obstructions. The sonde transmits electronic positioning signals to a worker vertically above the sonde, for example, by way of a hand-held complementary receiving device.

A drawback of pre-existing sondes for horizontal drilling systems is that these systems have typically used a simple bolt-on cover or lid for accessing the sonde housing. This type hold-down system was not always robust enough to withstand the rigors of the horizontal directional drilling environment, especially when drilling through hard formations such as rock, where substantial vibration is incurred. This was partly due to the fact that, in some cases, the sonde housing cover fit loose, rather than be held in place under tension. Also, the bolt head which extended from the sonde housing once the cover was in place could be caught and ripped off during drilling operations. Failure of the hold-down system could cause the sonde to be damaged or to fail. Also, if the tool were to become stuck in the hole being drilled, this could necessitate a costly and time consuming excavation operation to recover the tool, or to form a bore around the location at which the tool was lost. This results in costly in-ground repairs and parts replacements.

U.S. Pat. No. 5,934,391, to Cox, issued Aug. 10, 1999, shows one such prior art system featuring a sonde housing for horizontal directional drilling which includes a cylindrical housing body with walls defining a longitudinal cavity, a cover for the cavity and a hold-down mechanism for attaching the cover to the housing body. As shown in FIG. 5 of the patent, the hold-down mechanism for the housing included a bolt or series of bolts which could become caught and ripped off. This could lead to the kind of complications discussed above.

Thus, despite the advances that have been made in the art of directional drilling systems, there continue to exist a need for improvements in the component parts of such systems, such as the hold-down mechanisms used in securing the sonde housing lid.

SUMMARY OF THE INVENTION

A sonde housing is shown which is useful for horizontal directional drilling activities, sometimes referred to as "trenchless drilling." As has been mentioned, these types of drilling activities are commonly used, e.g., to install utilities around immovable objects, such as roadways, rivers and/or lakes, etc., and may be seen being used to tunnel under sidewalks and city streets to install such things as fiber optic cables, or other electrical utility lines. The sonde housing body is provided with a cover or lid which encloses the working components of the sonde. The invention is directed toward an improved hold-down system for such cover which is attached to a sonde housing body.

The improved sonde housing of the invention includes a cylindrical housing body with walls defining a longitudinal cavity. A cover is provided for the cavity, the cover having a top surface, a bottom surface, a front end and a rear end and opposing longitudinal side surfaces. The cover is also provided with a plurality of tabs extending from the longitudinal side surfaces of the cover which am engageablewithinmatinggroovesprovidedinthesondehousingbodyforslidablyengagingthetabs.

The cover is engageable within the cavity in the housing body by vertically positioning and partially engaging the cover therein, the cavity also being sized to allow longitudinal sliding movement of the cover within the cavity, thereby allowing the cover to move from a partially engaged position to a fully engaged position. A further independent locking element is also provided for securing the cover in the fully engaged position within the cavity in the sonde housing body.

The tab arrangement on the sides of the cover are specially designed to provide an enhanced locking and sealing action between the cover and the sonde housing body. This is accomplished by cutting the tabs which are provided on the longitudinal side surfaces of the cover at an inclined angle which forms a ramp surface with respect to the mating grooves provided in the sonde housing body. When the tabs engage the mating grooves in the sonde housing body during the longitudinal sliding movement of the cover within the housing cavity, pressure is created against the mating surfaces of the sonde housing body and the cover.

Preferably the additional locking element is a roll pin which engages both the sonde housing body and the cover when the cover is in place in the fully engaged position.

The sonde housing can further be provided with a sealing member located between the housing cover and the sonde housing body for forming a seal therebetween. The sealing member can conveniently be, for example, an O-ring seal.

Preferably, the roll pin is used to secure the cover to the housing body by passing the roll pin through an opening in the sonde housing body which is generally perpendicular to a longitudinal axis of the sonde housing body and mates with an opening provided adjacent one end of the cover to bold the cover securely in place, the roll pin having opposing ends which are entirely received within the opening provided in the sonde housing body so that no protruding surfaces extend outwardly from the housing body.

The roll pin engages the cover and sonde housing body to prevent the cover from sliding out of engagement with the grooves when the cover is fully engaged, with the primary loads on the cover being taken by the tabs and grooves.

A method is also shown for assembly a sonde housing of the type previously described in which the cover is lowered into the cavity formed in the housing body and slid forward so that the mating tabs and grooves engage as the cover moves from a partially engaged position to a fully engaged position. The roll pin is then inserted through the openings provided in the sonde housing body and the cover to secure the cover in place.

Additional objects, features and advantages will be apparent in the written description which follow.

DETAILED DESCRIPTION OF THE INVENTION

Figure 1:
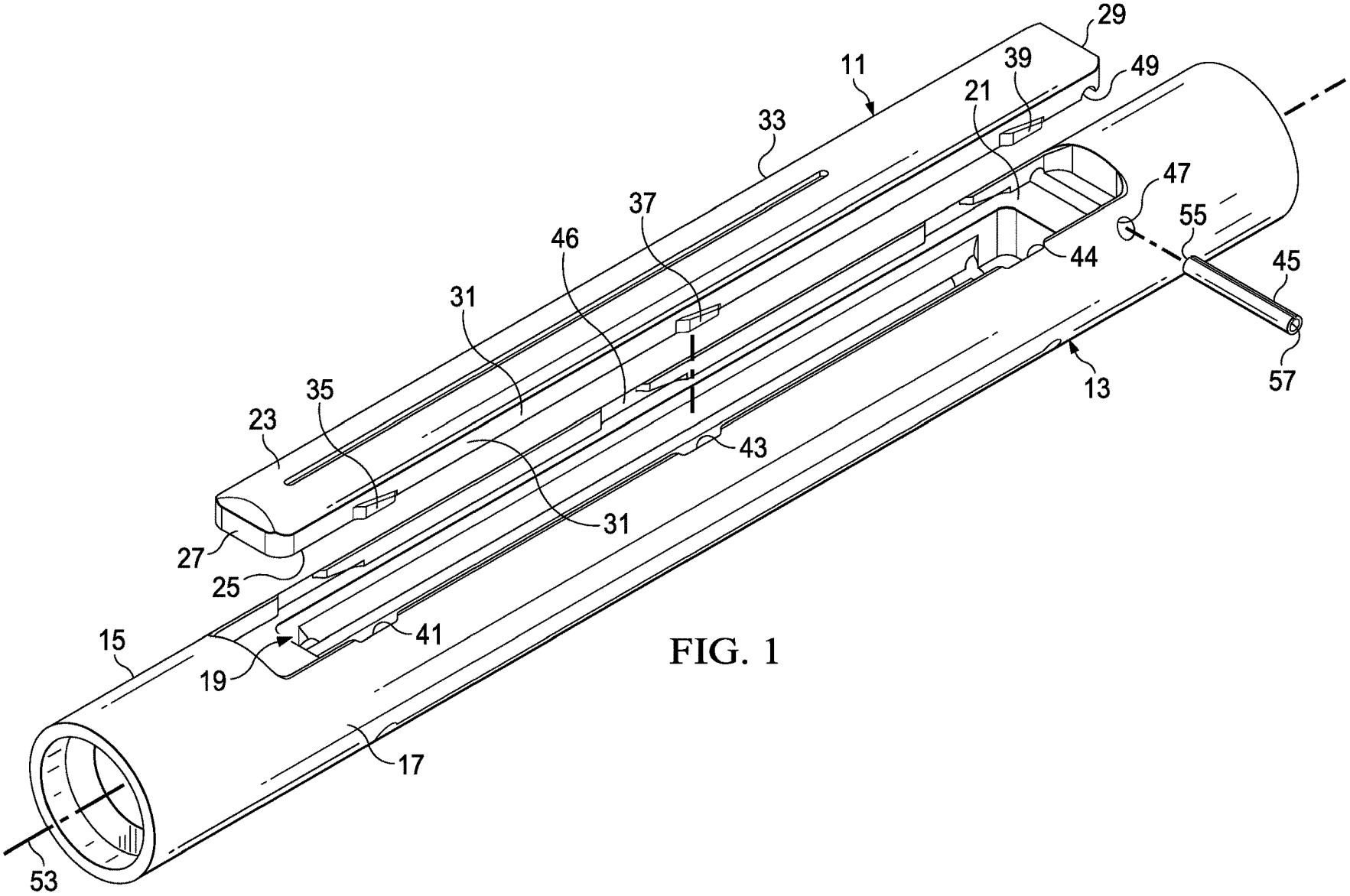
FIG. 1 is a perspective view of the sonde housing of the invention showing the locking lid in exploded fashion, for ease of illustration.

The preferred version of the invention presented in the following written description and the various features and advantageous details thereof are explained more fully with reference to the non-limiting examples included and as detailed in the description which follows. Descriptions of well-known components and processes and manufacturing techniques are omitted so as to not unnecessarily obscure the principal features of the invention as described herein. The examples used in the description which follows are intended merely to facilitate an understanding of ways in which the invention may be practiced and to further enable those skilled in the art to practice the invention. Accordingly, the examples should not be construed as limiting the scope of the claimed invention.

Referring to FIGS. 1-9, where like numerals indicate like and corresponding elements, there is shown a hold-down system for a lid or cover (11 in FIG. 1) which is attached to a sonde housing 13 of the type used for horizontal directional drilling. As previously explained, the sonde housing would typically follow the drill bit in the drill string of the drilling machine (not shown). Sonde housing 13 includes a cylindrical housing body 15 with cylindrical walls 17 which define a longitudinal cavity 19 which runs along a portion of the length of the housing. The longitudinal cavity 19 includes a shelf region 21 which circumscribes the interior region of the cavity. The shelf region is sized appropriately for receiving the cover 11 so that the opening to the cavity 19 is closed off when the cover is in place. As will be more fully explained, the cover 11 includes hold-down features which allow it to be securely attached to the sonde housing body 15, forming a more secure and reliable assembly than was achieved by the prior art devices.

As seen in FIG. 1, the cover 11 has a top surface 23, a bottom surface 25, opposing end surfaces 27, 29, and opposing longitudinal side surfaces 31,33. The cover 11 is also provided with a plurality of tabs, such as tabs 35, 37, 39, extending from the longitudinal side surfaces of the cover which are engageable with mating grooves (such as groove 46 shown in FIG. 1) provided in the sonde housing body 15 for slidably engaging the tabs. In the example shown in FIG. 1, there are three tabs located on each of the longitudinal side surfaces of the cover 11. However, the number of tabs might vary, including more or less than the six tabs shown. In the example of FIG. 1, two of the tabs visable on the side 31 are located adjacent the respective opposing ends 27, 29, of the cover, with one of the tabs being located approximately mid-way between the two end tabs. The tabs on the opposite side 33 are similarly located.

Lateral grooves are provided on either side of the housing body 15 (groove 46 shown in FIG. 1) and mate with the respective mating tabs (35, 37, 39 shown in FIG. 1) but have upper open portions to permit vertical pass-through of the tabs. These open portions are shown as 41, 43, 44, in FIG. 1 for the mating tabs 35, 37, 39. The respective tabs and mating grooves with their open portions are adapted and arranged to permit vertical engagement when the cover 11 is lowered into the cavity 19 and permit longitudinal sliding movement between a partially engaged position (shown in FIGS. 2 and 7) and a fully engaged position (shown in FIGS. 3 and 8). After full engagement, a locking element, such as roll pin 45 is installed to prevent further sliding movement of the cover. The roll pin is received in a lateral opening 47 provided in the sonde body and engages a mating semi-circular recess 49 in the cover (see FIG. 7). While the roll pin 45 holds the cover securely in place, it will be understood that the primary loads applied to the housing are taken by the tabs and grooves in use.

Figure 3:
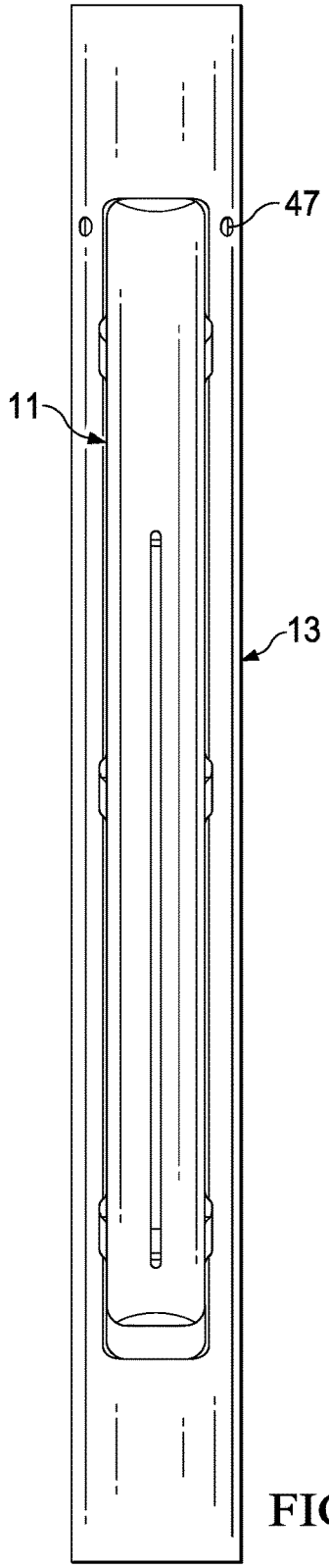
FIG. 3 is another top view of the sonde housing, similar to FIG. 2, but with the locking roll pin in place.
Figure 4:
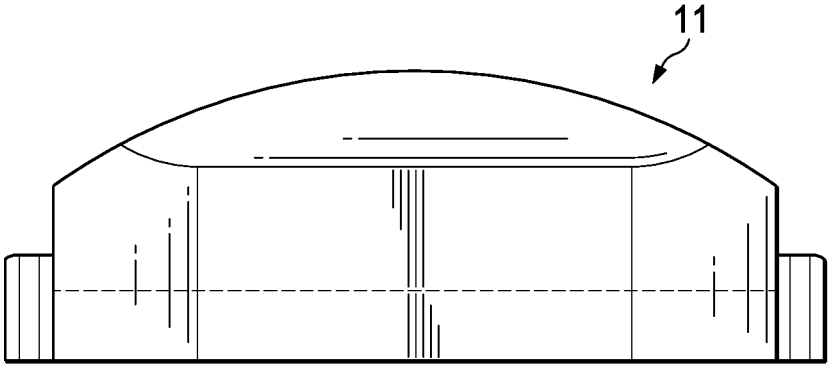
FIG. 4 is an end view of one end of the locking lid, as viewed from the perspective view of FIG. 1.
Figure 8:
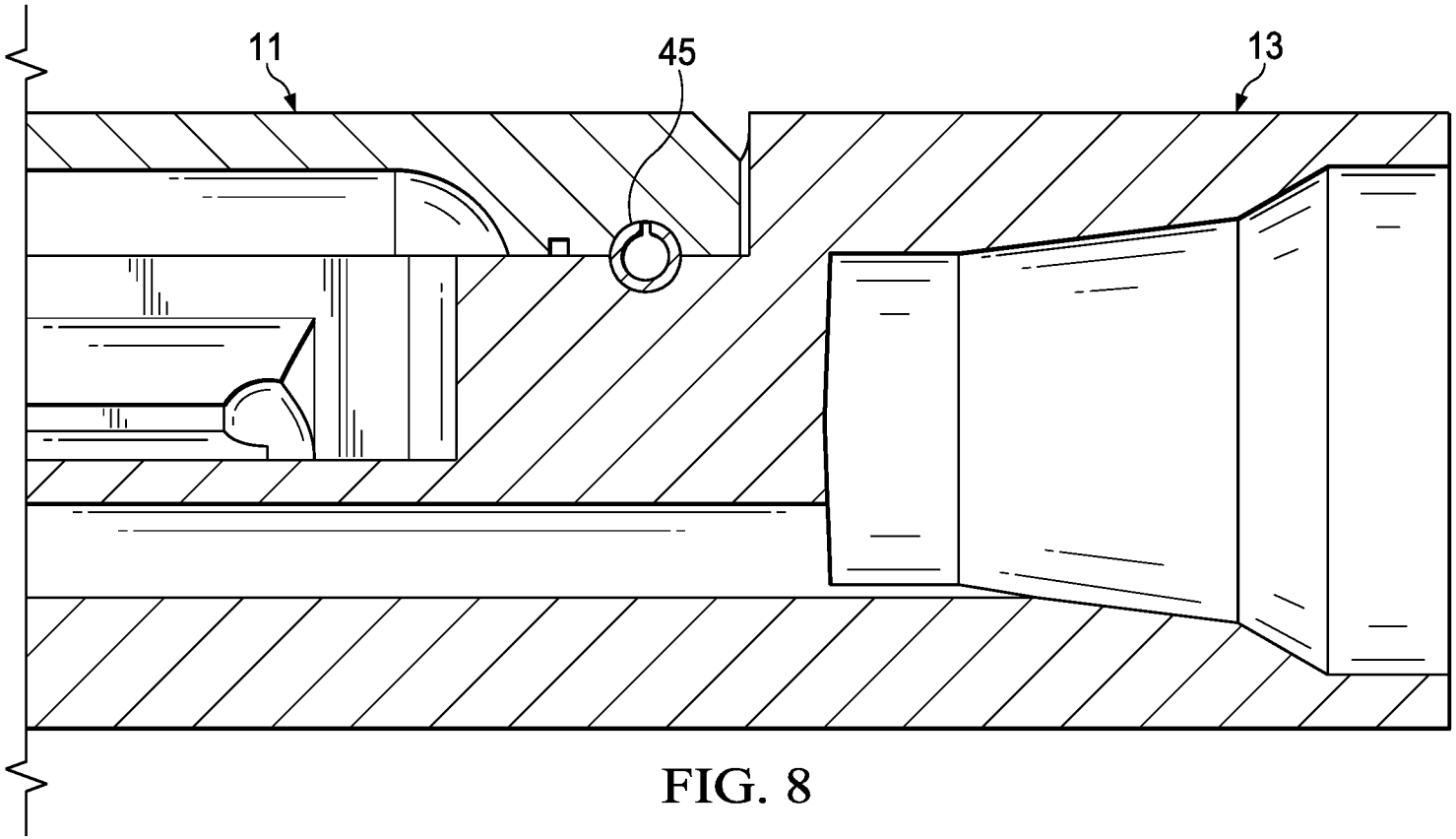
FIG. 8 is another view, similar to FIG. 7, but with the locking lid in its final assembled position and with the roll pin in place.
Figure 9:
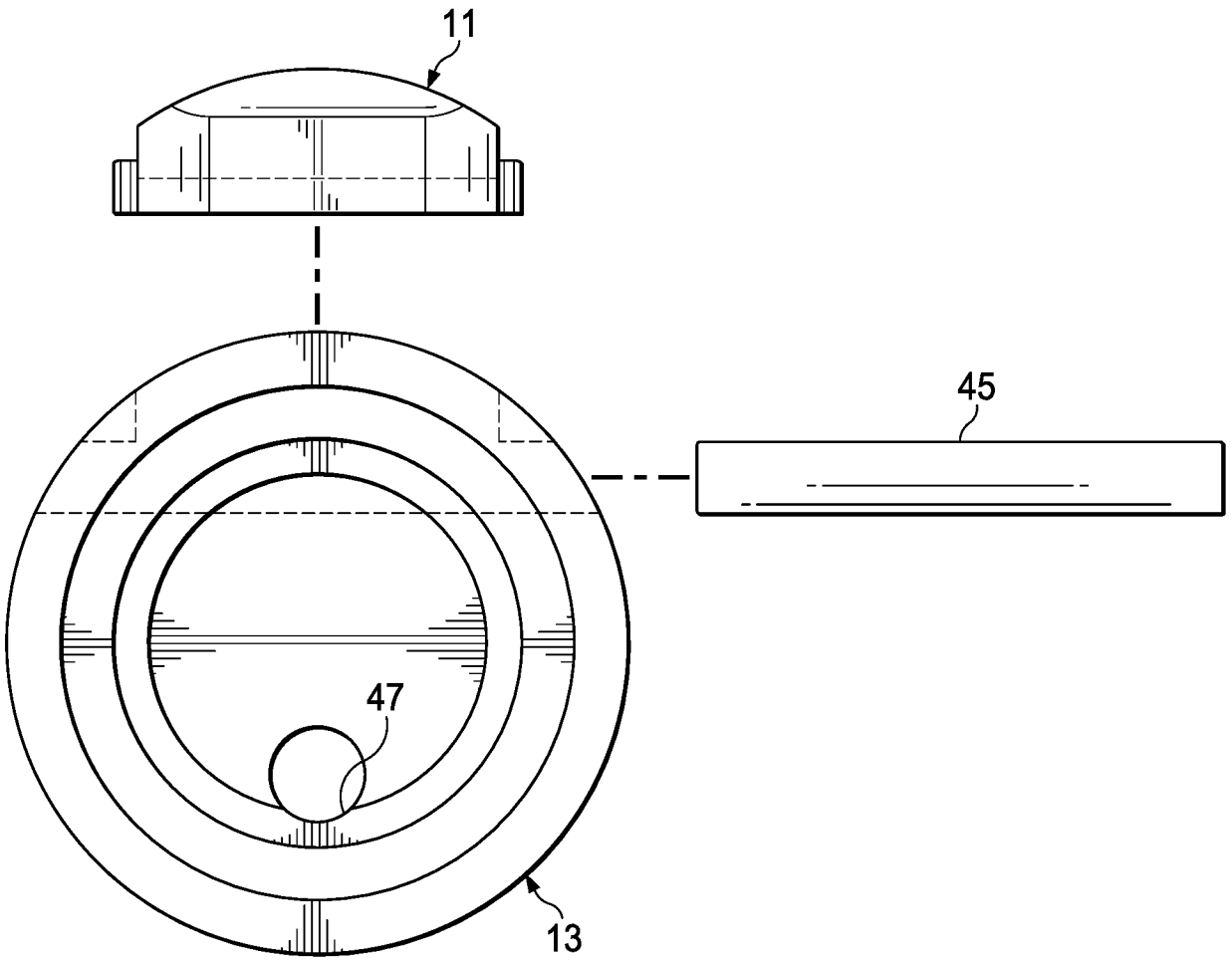
FIG. 9 is an end view of the sonde housing, locking lid and roll pin, prior to assembly.

In the example shown in FIGS. 3 and 8, the opening 47 in the housing body can be seen to be generally perpendicular to the longitudinal axis (53 in FIG. 1) of the sonde housing body 15 and lines up with the recess 49 provided adjacent one end of the cover 11 to hold the cover securely in place. The roll pin 45 has opposing ends 55, 57, which are entirely received within the opening 47 provided in the sonde housing body 15 so that no protruding surfaces extend outwardly from the housing body (see FIGS. 3 and 6).

Figure 5:
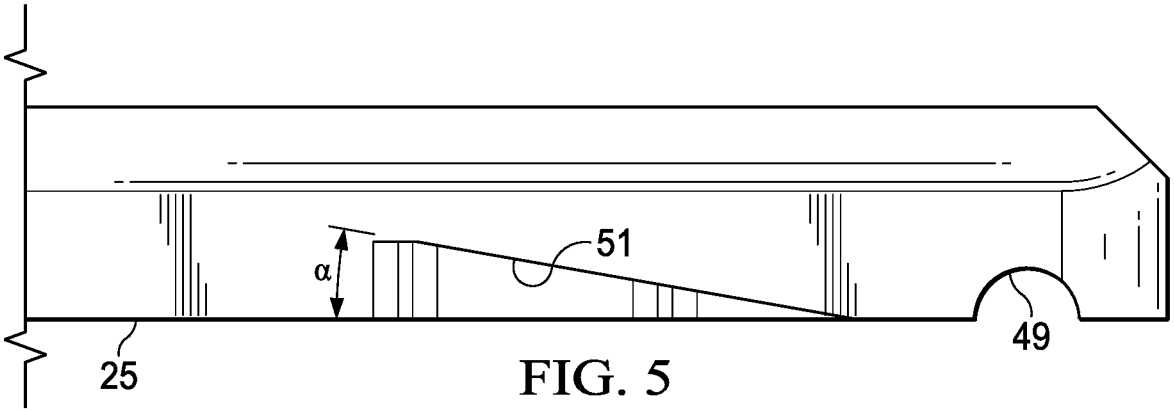
FIG. 5 is a side view of the first tab and roll pin area of the locking lid of FIG. 1.
Figure 6:
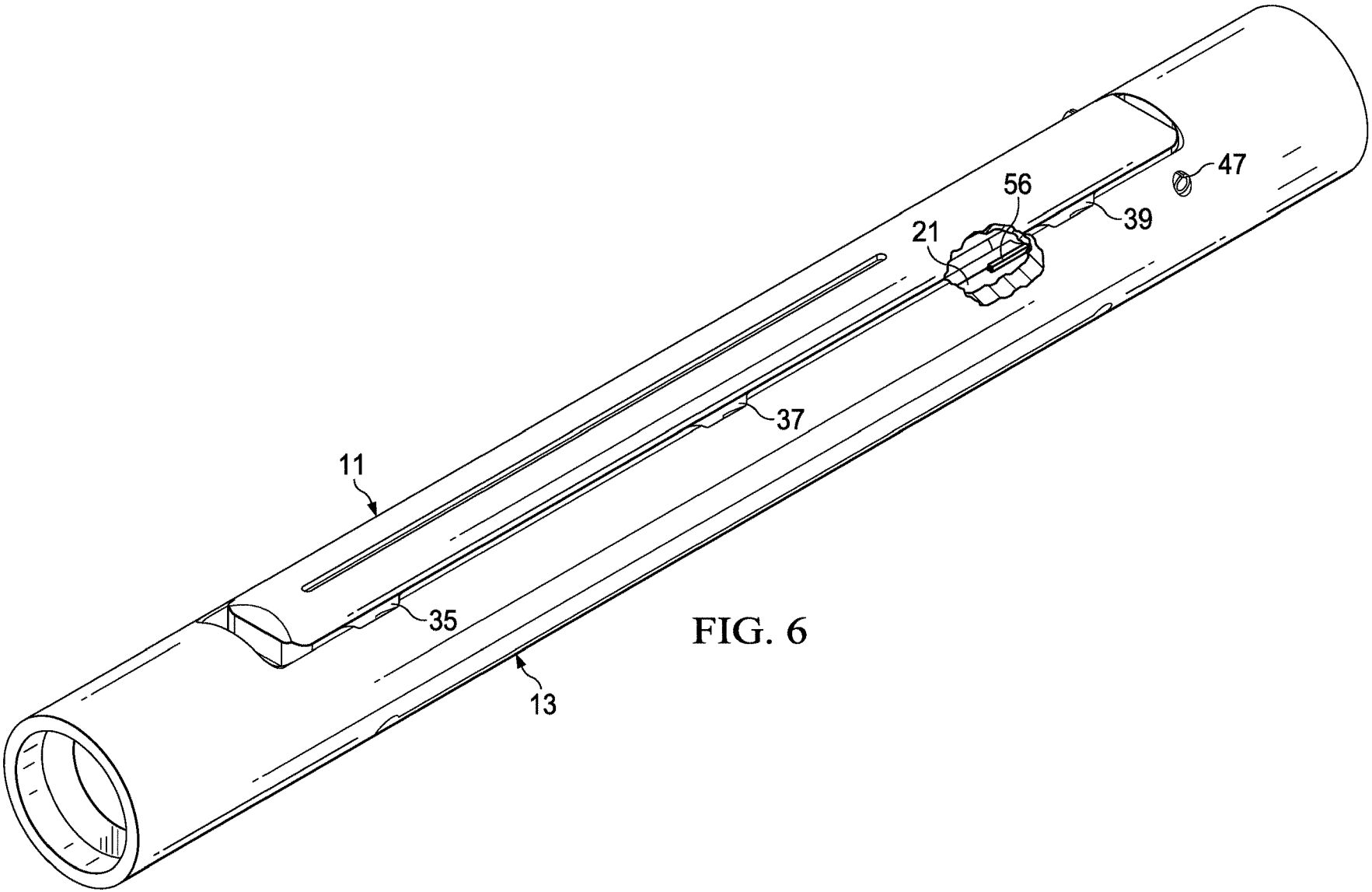
FIG. 6 is a another perspective view of the sonde housing, partly broken away to show the O-ring seal, and showing the locking lid in place and locked into position with a roll pin.
Figure 7:
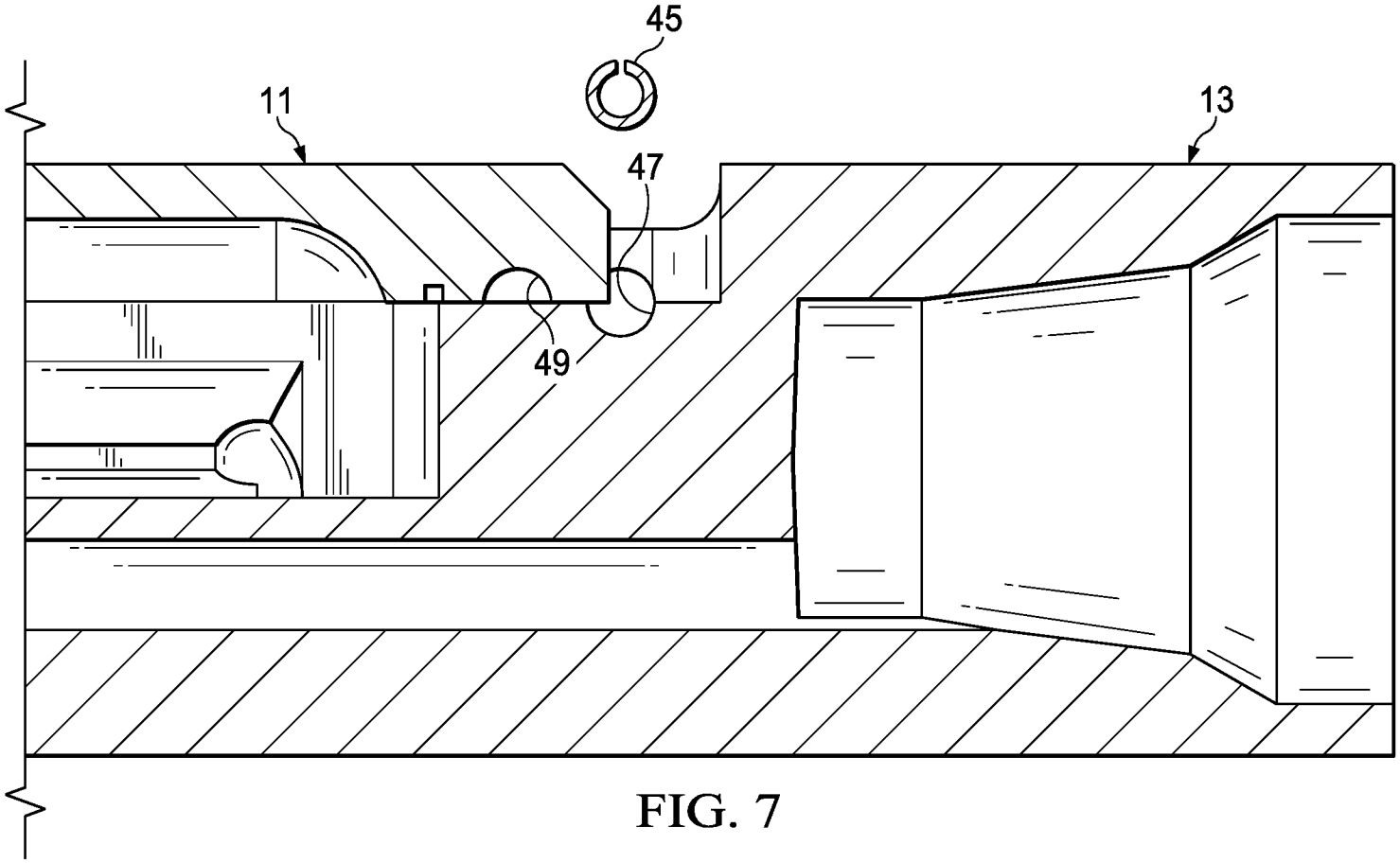
FIG. 7 is side, cross sectional view of a portion of one end of the sonde housing of the invention showing a leading end of the locking lid being moved into position before the roll pin is inserted.

With reference to FIGS. 1 and 5, it will be appreciated that the tabs 35,37, 39, which are provided on the longitudinal side surfaces 31,33, of the cover 11 are cut on an inclined angle ("α" in FIG. 5) which forms a ramp surface 51 with respect to the mating grooves provided in the sonde housing body so that when the tabs engage the mating grooves during the longitudinal sliding movement of the cover within the cavity 19, pressure is created against the mating surfaces of the sonde housing body and the cover. In the example shown in the drawings, the tabs which are provided on the longitudinal surfaces of the cover are cut at an angle in the range from about 5 to 20 degrees with respect to the bottom surface 25 in FIG. 5, and to the longitudinal center line (53 in FIG. 1) of the sonde housing body. For example, the ramp surfaces can be cut at a 10 degree angle.

A sealing member can also be provided between the housing cover 11 and the sonde housing body 15 for forming a seal therebetween. The sealing member is shown as 56 in the partly broken away view of FIG. 6. It will be understood that the seal member 56 rests on the shelf region 21 and circumscribes the shelf region to form a seal between the lid 11 and the cavity of the sonde housing body. Any convenient sealing member can be utilized which is capable of forming an adequate seal while withstanding the environment and conditions of use of the tool. For example, an O-ring seal or a gasket type seal might be utilized. In the preferred example shown in FIG. 6, the sealing member is 56 has a square profile. This particular seal member is a Square-Profile Oil-Resistant Buna-N,O-Ring Cord Stock™ sold by any number of commercial vendors such as McMaster, Grainger, Marco Rubber and Plastics, etc.

Figure 2:
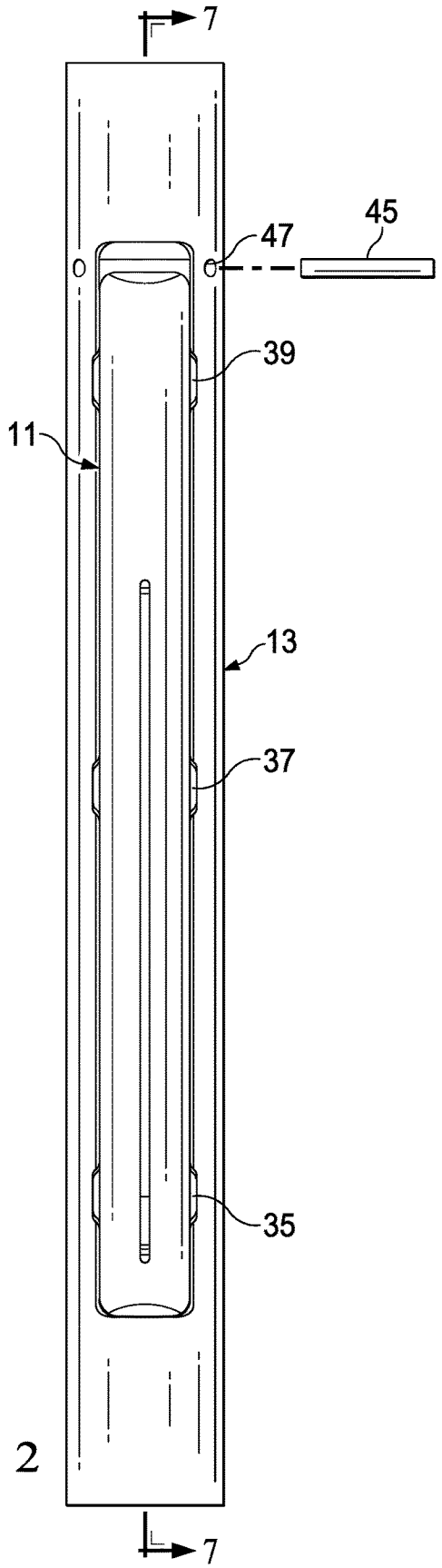
FIG. 2 is a top view of the sonde housing of FIG. 1, showing the locking lid in place and with the roll pin which is used to lock the lid in position prior to installation of the roll pin.

In operation, the lid 11 is installed by lowering the lid into the housing cavity and vertically engaging the tabs 35, 37, 39, with the open portions of the grooves 41, 43, 44, then longitudinally sliding the lid forward from the partially engaged position shown in FIG. 2 to the fully engaged position shown in FIG. 3. Since the tabs have an inclined angle, engaging the tabs in the grooves of sonde housing body creates pressure against the mating surfaces of the sonde housing and the lid. Installing the roll pin 45 (see FIG. 2) in the opening 47 in the sonde housing body completes the installation.

An invention has been provided with several advantages. The hold-down system of the invention ensures that the cover for the sonde housing is securely held in place even during the rigors of drilling through hard formations. The improved hold-down system of the invention can thus help prevent the premature failure of the sonde region of the drilling apparatus, which failure could be occasioned, for example, by the prior art bolt heads used in securing the cover being caught and ripped loose. The improved hold-down system lessens the chance that a portion of the drill string could become stuck in a borehole or pipe. Field operators will appreciate that such a stuck tool often necessitates a costly and time consuming excavation operation to recover the tool, or to form a bore around the location at which the tool was lost. This results in costly in-ground repairs and parts replacements. The hold-down system of the invention provides a means for extending the useful service lifetime of the drilling apparatus under consideration.

While the invention has been shown in only one of its forms, it will be appreciated that it is not thus limited, but is susceptible to various changes and modifications without departing from the spirit thereof.

What is claimed is:

1. A sonde housing for horizontal directional drilling, comprising:

a cylindrical housing body with walls defining a longitudinal cavity;

a cover for the cavity, the cover having a top surface, a bottom surface, opposing end surfaces and opposing longitudinal side surfaces, the cover being provided with a plurality of tabs extending from the longitudinal side surfaces of the cover which are engageable within mating grooves provided in the sonde housing body for slidably engaging the tabs;

wherein the cover is engageable within the cavity in the housing body by vertically positioning and partially engaging the cover therein, the cavity also being sized to allow longitudinal sliding movement of the cover within the cavity, thereby allowing the cover to move from a partially engaged position to a fully engaged position;

a locking element for securing the cover in the fully engaged position within the cavity in the sonde housing body;

and wherein the tabs which are provided on the longitudinal side surfaces of the cover are cut on an inclined angle which forms a ram surface with respect to the mating grooves provided in the sonde housing body so that when the tabs engage the mating grooves during the longitudinal sliding movement of the cover within the cavity pressure is created against the mating surfaces of the sonde housing body and the cover; and wherein the tabs which are provided on the longitudinal surfaces of the cover are cut at an angle in the range from about 5 to 20 degrees with respect to a longitudinal center line of the sonde housing body.

2. The sonde housing of claim 1, wherein the locking element is a roll pin which engages both the sonde housing body and the cover when the cover is in place in the fully engaged position.

3. The sonde housing of claim 2, wherein the sonde housing further has a sealing member located between the housing cover and the sonde housing body for forming a seal therebetween.

4. The sonde housing of claim 3, wherein the sealing member is an O-ring seal.

5. The sonde housing of claim 1, wherein there are three tabs longitudinally spaced apart on each of the two longitudinal side surfaces of the sonde housing body.

6. The sonde housing of claim 1, wherein the roll pin passes through an opening in the sonde housing body which is generally perpendicular to a longitudinal axis of the sonde housing body and mates with an opening provided adjacent one end of the cover to hold the cover securely in place, the roll pin having opposing ends which are entirely received within the opening provided in the sonde housing body so that no protruding surfaces extend outwardly from the housing body.

7. The sonde housing of claim 6, wherein the roll pin engages the cover and sonde housing body to prevent the cover from sliding out of engagement with the grooves when the cover is fully engaged, so that primary loads on the cover are taken by the tabs and grooves.

8. A method for assembling a sonde housing used in directional drilling, the method comprising the steps of:

providing a cylindrical housing body with walls defining a longitudinal cavity;

providing a cover for the cavity, the cover having a top surface, a bottom surface, opposing end surfaces and opposing longitudinal side surfaces, the cover being provided with a plurality of tabs extending from the longitudinal side surfaces of the cover which are engageable within mating grooves provided in the sonde housing body for slidably engaging the tabs;

wherein the cover is engageable within the cavity in the housing body by vertically positioning and partially engaging the cover therein, the cavity also beings sized to allow longitudinal sliding movement of the cover within the cavity, thereby allowing the cover to move from a partially engaged position to a fully engaged position;

positioning the cover within the cavity and fully engaging the cover within the cavity by sliding longitudinal movement;

wherein the tabs which are provided on the longitudinal side surfaces of the cover are cut on an inclined angle which forms a ramp surface with respect to the mating grooves provided in the sonde housing body so that when the tabs engage the mating grooves during the longitudinal sliding movement of the cover within the cavity pressure is created against the mating surfaces of the sonde housing body and the cover;

further securing the cover within the cavity by engaging a roll pin between the sonde housing body and the cover when the cover is in place in the fully engaged position; and wherein the tabs which are provided on the longitudinal surfaces of the cover are cut at an angle in the range from about 5 to 20 degrees with respect to a longitudinal center line of the sonde housing body.

9. The method of claim 8, wherein there is further provided a sealing member which is located between the housing cover and the sonde housing body for forming a seal therebetween.

10. The method of claim 8, wherein there are three tabs longitudinally spaced apart on each of the two longitudinal side surfaces of the sonde housing body.

11. The method of claim 10, wherein the roll pin is passed through an opening in the sonde housing body which is generally perpendicular to a longitudinal axis of the sonde housing body and mates with an opening provided adjacent one end of the cover to hold the cover securely in place, and wherein the roll pin has opposing ends which are entirely received within the opening provided in the sonde housing body so that no protruding surfaces extend outwardly from the housing body.

12. The method of claim 11, wherein the roll pin engagement between the cover and sonde housing body serves to prevent the cover from sliding out of engagement with the grooves when the cover is fully engaged, so that primary loads on the cover are taken by the tabs and grooves.

* * * * *